US009008527B2

(12) United States Patent
Kuo et al.

(10) Patent No.: US 9,008,527 B2
(45) Date of Patent: Apr. 14, 2015

(54) METHOD FOR CALIBRATING SPECIALTY COLOR TONER

(71) Applicants: Chung-Hui Kuo, Fairport, NY (US); Michael Wu, Fairport, NY (US)

(72) Inventors: Chung-Hui Kuo, Fairport, NY (US); Michael Wu, Fairport, NY (US)

(73) Assignee: Eastman Kadak Company, Rochester, NY (US)

( * ) Notice: Subject to any disclaimer, the term of this patent is extended or adjusted under 35 U.S.C. 154(b) by 0 days.

(21) Appl. No.: 13/917,817

(22) Filed: Jun. 14, 2013

(65) Prior Publication Data

US 2014/0369701 A1 Dec. 18, 2014

(51) Int. Cl.
*G03G 15/00* (2006.01)

(52) U.S. Cl.
CPC ..... *G03G 15/50* (2013.01)

(58) Field of Classification Search
CPC ..... G03B 15/5062
USPC ..... 399/15, 27, 28, 49
See application file for complete search history.

(56) References Cited

U.S. PATENT DOCUMENTS

| | | | | |
|---|---|---|---|---|
| 5,103,260 | A * | 4/1992 | Tompkins et al. | 399/39 |
| 7,324,240 | B2 | 1/2008 | Ng | |
| 7,777,915 | B2 | 8/2010 | Kuo et al. | |
| 8,340,542 | B2 | 12/2012 | Yoshida | |
| 2005/0244179 | A1 * | 11/2005 | Rakov et al. | 399/66 |

* cited by examiner

*Primary Examiner* — Clayton E Laballe
*Assistant Examiner* — Minh Phan
(74) *Attorney, Agent, or Firm* — Peyton C. Watkins

(57) ABSTRACT

A method for calibrating specialty toner, the method includes providing a substrate; depositing an invariant or substantially invariant laydown of a color toner on the substrate; depositing a varying laydown of the specialty toner; fusing the color toner and specialty toner to the substrate; measuring a color response signal of the substrate, color toner, and specialty toner; calculating a color response curve as function of the varying laydown of the specialty toner; comparing the color response curve to a target color response curve; and modifying printing parameters of the specialty toner to set the color response curve equal to or substantially equal to the target color response curve.

7 Claims, 7 Drawing Sheets

METHOD FOR CALIBRATING SPECIALTY COLOR TONER

FIELD OF THE INVENTION

The present invention generally relates to calibrating and subsequently using toner and, more particularly, to calibrating and using specialty toner such as white, clear, pearlescent, metallic and fluorescence toner.

BACKGROUND OF THE INVENTION

Digital color reproduction printing systems typically include digital front-end processors, digital color printers, and post finishing systems (e.g., glosser system, binding system). These systems reproduce original color onto substrates (such as paper). The digital front-end processes take input electronic files (such as PDF or postscript files) composed of imaging commands and images from other input devices (e.g., a scanner, a digital camera) together with its own internal other function processes (e.g., raster image processor, image positioning processor, image manipulation processor, color processor, image storage processor, substrate processor, etc) to rasterize the input electronic files into proper image bitmaps for the printer to print. An operator may be assisted to set up parameters such as layout, font, color, paper, post-finishing, etc. among those digital front-end processes. The printer (e.g., an electrographic printer) takes the rasterized bitmap and renders the bitmap into a form that can control the printing process from the exposure device to writing the image onto paper. The post-finishing system finalizes the prints by adding finishing touches such as protection, glossing, and binding etc.

In an electrophotographic modular printing machine of known type, for example, the Eastman Kodak NexPress 2100 printer manufactured by Eastman Kodak, Inc., of Rochester, N.Y., color toner images are made sequentially in a plurality of color imaging modules arranged in tandem, and the toner images (also referred to as Dry Ink images) are successively electrostatically transferred to a receiver member adhered to a transport web moving through the modules. Commercial machines of this type typically employ intermediate transfer members in the respective modules for the transfer to the receiver member of individual color separation toner images. In other printers, each color separation toner image is directly transferred to a receiver member.

Electrophotographic printers having multicolor capability are known to also provide an additional toner depositing assembly for depositing specialized toners such as clear toner, pearlescent toner, metallic toner or lightly tinted toner. The purpose and use of these specialized toners depends upon the customer needs and can include gloss control, watermarking, security printing, highlighting with sheen and many other effects that go far beyond the original introduction of only clear toner for gloss effects and image overcoating.

Currently, there are methods for calibrating color toners such as cyan, magenta, yellow or black. These methods typically deposit the color toner onto a white substrate and then measure color response such as CIELAB or density using, for example, a spectrophotometer or reflection densitometer respectively. Some color responses, such as CIELAB, are more useful for relating to human color perception other color responses, such as XYZ tristimulus or Status A densitometry can work well for process control of color output. Process control refers to the control of the CMYK color toner laydown in an electrophotographic printer to achieve a consistent output color profile (Kuo et. al, U.S. Pat. No. 7,777,915).

A refinement of the traditional process control of the subtractive CMYK color toner was the introduction of additional color profiles to account for the effect of overcoat clear toner on the fusing process of the underlying color toner. In order to get more consistent color results for the CMYK images, U.S. Pat. No. 7,324,240 introduced the use of two color profiles one for the CMYK toner regions where clear toner is present and a separate color profile for the CMYK toner regions where there is no clear toner present. This patent found that the presence of clear toner on top of the CMYK toner changes the flow of the color toner below when it melts in the fusing step. Consequently, the color below the clear toner is not the same as the color of other portions of the substrate that do not have clear toner on top. While U.S. Pat. No. 7,324,240 also provides for multiple CMYK color profiles for different laydowns of clear toner, U.S. Pat. No. 7,324,240 does not provide a means for measuring and controlling the laydown of the clear toner.

U.S. Pat. No. 8,340,542 does provide a means for controlling the laydown of a clear toner layer provided to enhance transfer by measuring the scattering effect of the unfused clear toner on a an intermediate transfer surface. However, U.S. Pat. No. 8,340,542 does not provide a means for measuring the laydown of the clear toner in the image, nor does U.S. Pat. No. 8,340,542 account for the effect of fusing in the final print appearance that can only be detected by measuring the color signal of the toner (clear or CMYK) after fusing.

Color measurement after fusing of clear toner or other specialty toners such as white, clear, pearlescent, metallic and fluorescence toner deposited directly onto a receiver is very difficult because of the very low contrast of the clear toner compared to the white paper where no clear toner is present. But the increasing customer interest in features that are created using specialty toners now makes it necessary to apply process control to the specialty toner channel in order to maintain consistent high quality.

Thus, a robust and easy means for measuring the laydown of clear toner on an image or substrate after fusing is currently lacking and is provided in this invention.

SUMMARY OF THE INVENTION

The present invention is directed to overcoming one or more of the problems set forth above. Briefly summarized, according to one aspect of the invention, the invention resides in a method for calibrating the laydown of specialty toner, the method comprising providing a substrate, depositing a region of color toner laydown at a single toner laydown amount on the substrate, depositing a series of patches at varying laydown of the specialty toner and fusing the specialty toner and color toner to the receiver. Then, measuring a color response signal such as the density response of the substrate, color toner, and specialty colors and calculating a color response curve, in this case density as a function of the varying laydown of the specialty toner. Comparing the color response curve to a target color response curve and modifying printing parameters, in particular the charging voltage of the specialty toner image forming module to set the color response curve equal to the target color response curve.

Controlling specifically the charging voltage in a discharge area development image forming module provides a particular simple and robust process control system that simply controls the maximum laydown of the specialty color.

The specialty toner can be any from a list of toner including white, clear (or low tint), pearlescent, metallic and fluorescent toner. The underlying color toner can be either black or any combination of cyan, magenta, yellow or black. In a preferred embodiment, when using specialty toner that has a tint, the color toner is a complementary color of a primary component of the color of the specialty toner.

In another embodiment, a method for calibrating the laydown of specialty toner includes providing a color substrate, depositing a series of patches at varying laydown of the specialty toner and fusing the specialty toner to the receiver. Then, measuring a color response signal such as the density response of the substrate and specialty colors and calculating a color response curve, in this case density as a function of the varying laydown of the specialty toner. Comparing the color response curve to a target color response curve and modifying printing parameters, in particular the charging voltage of the specialty toner image forming module to set the color response curve equal to the target color response curve.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1:
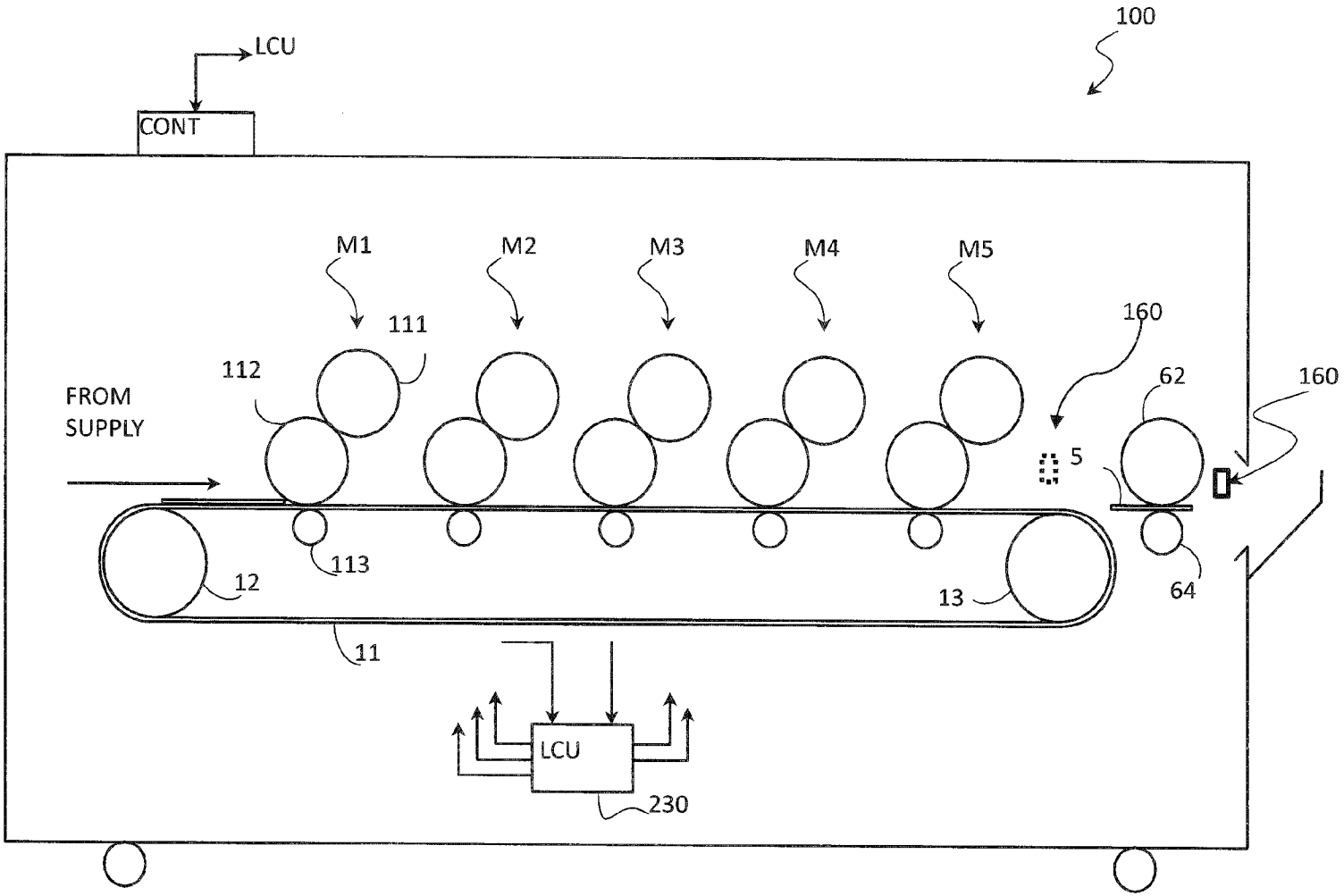
FIG. 1 a side elevational view schematically showing portions of a typical electrophotographic printer.

Turning now to FIG. 1, a useful printing machine is illustrated in FIG. 1 of the present application. FIG. 1 is a side elevational view schematically showing portions of a typical electrophotographic print engine or printer apparatus suitable for printing of one or more toner images. An electrophotographic printer apparatus 100 has a number of sequentially arranged electrophotographic image forming printing modules M1, M2, M3, M4, and M5. Each of the printing modules M1, M2, M3, M4, M5 generates a single dry toner image for transfer to a receiver material successively moved through the printing modules M1-M5. Each receiver material, during a single pass through the five printing modules M1, M2, M3, M4, M5, can have transferred in registration thereto up to five single toner images. A composite color toner image formed on a receiver material can comprise combinations or subsets of the CYMK color toner images and the fluorescing yellow polymeric toner particles described herein on the receiver material over the composite color toner image on the receiver material. In a particular embodiment, printing module M1 forms non-fluorescent black (K) toner color separation images, M2 forms fluorescent or non-fluorescent yellow (Y) toner color separation images, M3 forms non-fluorescent magenta (M) toner color separation images, and M4 forms non-fluorescent cyan (C) toner color separation images. Printing module M5 forms specialty toner colors that are used to print specialty colors when desired. Printing module M5 is also used to calibrate the specialty colors during a calibration run, as described below, which calibration is then used by a logic control unit 230 when printing the specialty colors in actual consumer printing. The specialty toner is preferably either pearlescent, white, clear, metallic or fluorescence.

Receiver materials 5 as shown in FIG. 1 are delivered from a paper supply unit (not shown) and transported through the printing modules M1-M5. The receiver materials 5 are adhered [for example electrostatically using coupled corona tack-down chargers (not shown)] to an endless transport 11 entrained and driven about rollers 12 and 13. Each of the printing modules M1-M5 includes a photoconductive imaging roller 111, an intermediate transfer roller 112, and a transfer backup roller 113, as is known in the art. For example, at printing module M1, a particular toner separation image can be created on the photoconductive imaging roller 111, transferred to intermediate transfer roller 112, and transferred again to a receiver material 5 moving through a transfer station, which transfer station includes intermediate transfer roller 112 forming a pressure nip with a corresponding transfer backup roller 113.

A receiver material 5 can sequentially pass through the printing modules M1 through M5. The receiver material 5 can receive any combination of the toner from module M1-M5.

Electrophotographic printing apparatus 100 has a fuser of any well known construction, such as the shown fuser assembly using fuser rollers 62 and 64. Even though a fuser using fuser rollers 62 and 64 is shown, it is noted that different non-contact fusers using primarily heat for the fusing step can be beneficial as they can reduce compaction of toner layers formed on the receiver material 5, thereby enhancing tactile feel.

After fusing (preferred) or prior to fusing, a color response signal must be detected from the image consisting of regular colored toner and the specialty toner. This can be done conveniently by placing an in-line densitometer 160 shown in its preferred location after fusing (or in dotted line prior to fusing). Another alternative, not shown, is to read the color signal off-line for example by a slit scanner in a finishing device or even manually using a flat bed scanner.

The logic control unit (LCU) 230 can include one or more processors and in response to signals from various sensors (CONT) associated with the electrophotographic printer apparatus 100, provides timing and control signals to the respective components to provide control of the various components and process control parameters of the apparatus as known in the art.

Figure 2:
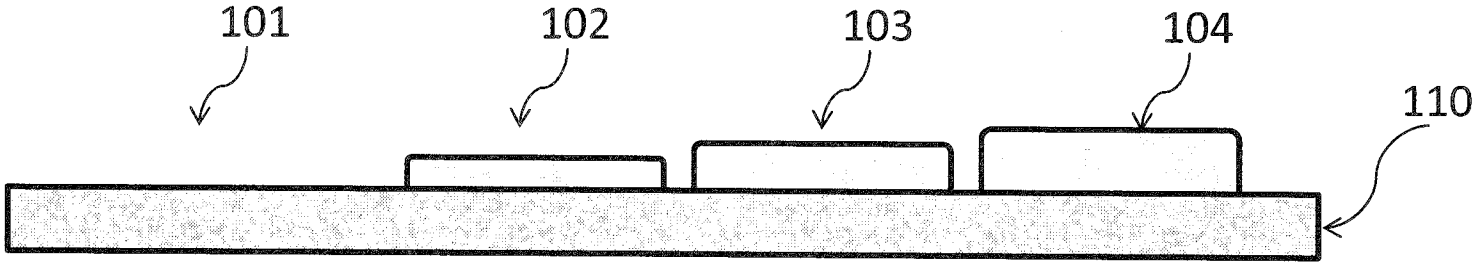
Figure 2 (prior art)
FIG. 2 is a prior art substrate having low density specialty toner deposited on the substrate at different laydowns.
Figure 5:
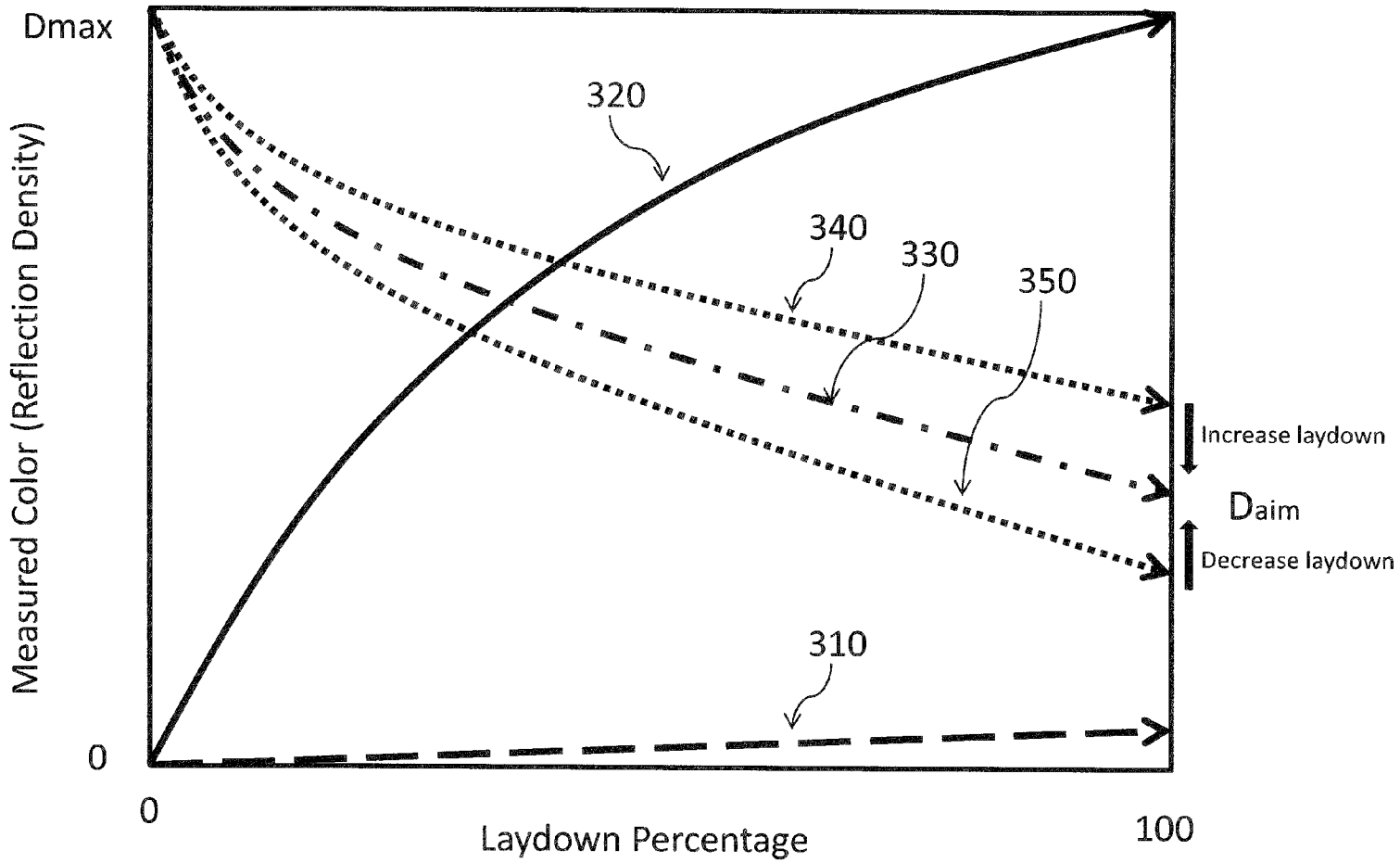
FIG. 5 illustrates typical plots of the reflection density signals produced using the preferred embodiment of the present invention and contrasting plots not using the present invention to more clearly illustrate the utility of the present invention.

Referring to FIG. 2 (prior art or problem statement), there is shown a substrate 110 (such as the receiver material 5) having clear or low tint specialty toner deposited on the substrate 110. The substrate 110 in this embodiment is a receiver material 5 suitable for printing such as paper, and the substrate 110 is preferably white or very nearly white in this embodiment. The specialty toner 101, 102, 103 and 104 is deposited on the substrate 110 in a plurality of varying laydowns (i.e., thickness of toner). Only one particular type of the available specialty toners 101, 102, 103 and 104 is preferably deposited on the substrate 110. Regardless of the type (clear, white, pearlescent, low tint, metallic) it is understood that specialty toner 101, 102, 103 and 104 has a very low contrast when compared to the white substrate 110. As a result, when density measurements are made as described below, a very weak signal is obtained (FIG. 5, curve 310). It is understood from the specialty toner 101, 102, 103 and 104 are fused to the substrate 110 by the printing apparatus 100 prior to measurement.

Figure 3:
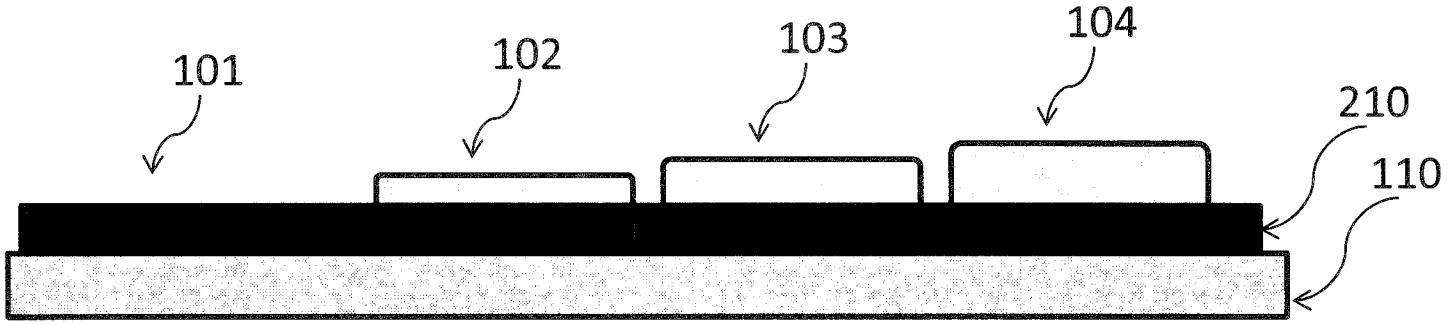
FIG. 3 is a substrate having a color toner deposited on the substrate at a constant laydown and low density specialty toner deposited on the substrate at different laydowns according to the present invention.

Referring to FIG. 3, there is shown a substrate 110 (such as the receiver material 5) having color toner 210 deposited on the substrate 110 in a consistent or substantially consistent laydown amount (i.e., thickness). In other words, the amount of laydown of the color toner 210 is invariant or substantially invariant. The substrate 110 in this embodiment is a receiver material 5 suitable for printing such as paper, and the substrate 110 is preferably white or very nearly white in this embodiment. The color toner 210 is preferably either black, or any combination of magenta, cyan, yellow or black. It is also noted that the color toner 210 is preferably a complimentary color of a primary component of the color of the specialty toner 101, 102, 103 and 104. The specialty toner 101, 102, 103 and 104 is deposited on the color toner 210 in a plurality of varying laydowns (i.e., thickness of toner). The specialty toner 101, 102, 103 and 104 with the color toner 210 fused to the substrate 110 is collectively referred to as the calibration document (see FIG. 7). It is noted that the specialty toner labled 101 is the 0% laydown case, which in this case will give the maximum signal of the underlying toner layer when the color signal is detected. Only one particular color of the available specialty toner 101, 102, 103 and 104 is preferably deposited on the substrate 110. It is understood that each color of the other available specialty toner 101, 102, 103 and 104 are also deposited on subsequent substrates 110 in a similar fashion. It is understood from the color toner 210 and specialty toner 101, 102, 103 and 104 are fused to the substrate 110 by the electrophotographic printing apparatus 100.

As is well known in the art, toner does not precisely exhibit the desired color at each laydown due to slight tolerances in the toner composition and tolerances of the printing apparatus 100. Therefore, it is desirable to calibrate the toner to a target toner color before printing images used for consumer use. This enables the user to print more aesthetically pleasing images. The present invention provides a method for calibrating specialty colors to a target.

Figure 4:
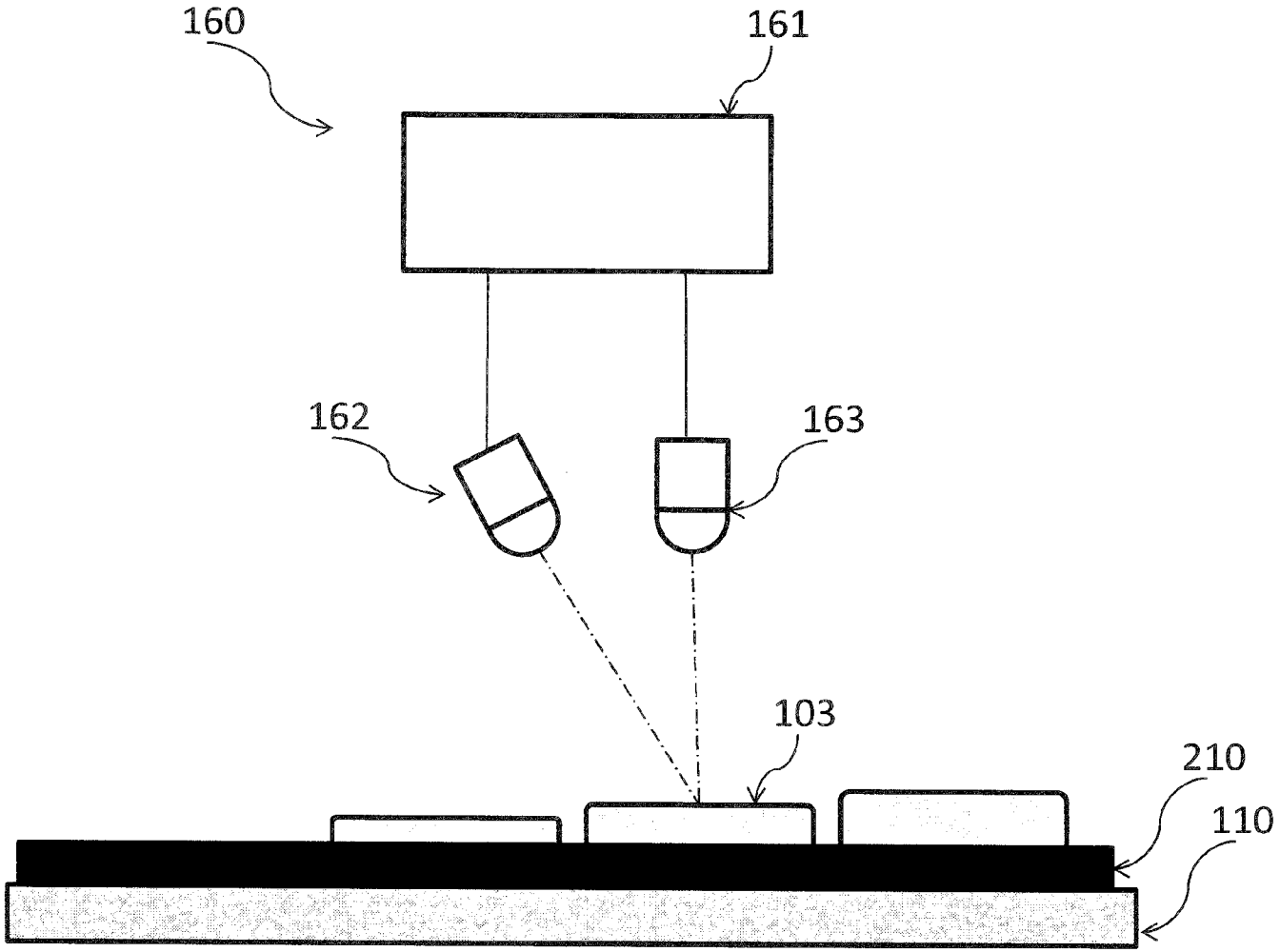
FIG. 4 is a densitometer for taking color signal measurements of the fused specialty toner and colored toner on the substrate according to the present invention.

Referring to FIG. 4, there is shown the in-line densitometer 160 used for measuring the specialty toner 101, 102, 103 and 104. The in-line densitometer 160 may be separate from the electrophotographic printing apparatus 100 or incorporated into the printing unit. The substrate 110 with the specialty toner 101, 102, 103 and 104 and color toner 210 is passed under a light source 162 which emits light onto each laydown of the specialty color 101, 102, 103 and 104 which is reflected off the specialty toner 101, 102, 103 and 104 for measuring the color signal of the substrate 110, color toner 210 and specialty toner 101, 102, 103 and 104. A sensor 163 receives and measures the reflected color signal. The color signal is preferably a reflected signal but the present invention is not limited to reflected color signals. A logic unit 161 controls the operation of the light source 162 and the sensor 163.

Referring to FIG. 5, the resulting color signal is used to calculate or determine a negative sloped tone scale curve of which FIG. 5 is an example. Two typical measurements of the substrate 210, specialty color toner 101, 102, 103 and 104 and color toner 210 are labeled as 340 and 350. Curve 340 illustrates the case where the measured laydown produces higher color reflection density than the target curve 330 (also referred to in the art as an aim curve). The curve 350 illustrates the case where the measured curve 350 produces lower color reflection density than the target curve 330. The target curve 330 is illustrated as a typical aim curve and it is understood that other aim curves may be used without departing the scope of the present invention. It is also understood that only one curve is produced from the measured reflection and curves 340 and 350 are intended to illustrate typical curves.

Curve 320 is shown to illustrate color toner without the specialty toner 101, 102, 103 and 104. This curve 320 is produced by depositing color toner 210 on a substrate 110, preferably white, to illustrate the difference between this curve 320 and curves 340 and 350. It is noted that the curve 320 is positively sloped as contrasted with the curves 340 and 350 of the present invention which are negatively sloped. Curve 310 illustrates specialty color 101, 102, 103 and 104 deposited directly on a substrate without color toner 210 deposited underlying the specialty toner 101, 102, 103 and 104 (as shown in FIG. 2) to illustrate the positively sloped trend as opposed to the negatively sloped curves 340 and 350 of the present invention. The present invention recognizes utility in negatively sloped curves as produced by the substrate 110, specialty toner 101, 102, 103 and 104 and color toner 210 so that these colors may be used in printing without noticeable artifacts as described below.

In order to get the curve 340 back to the target curve 330, the laydown of the toner is increased. Similarly, to get the curve 350 to the target curve 330, the laydown of the specialty toner 101, 102, 103 and 104 is decreased.

The curves 340 and 350 are stored by the electrophotographic printing apparatus 100 so that the curves 340 and 350 may be used by the control logic unit 230 of the electrophotograhic printer 100 to modify prints and the like for consumer use that are equal or substantially equal the target curve 330 for producing aesthetically pleasing images. For example, when the electrophotographic printer apparatus 100 desires to print one or more of the specialty toners 101, 102, 103, and 104, on a substrate 110 for consumer use, the logic control unit 230 modifies the particular laydown of the specialty toner 101, 102, 103, and 104. Consequently, the specialty toners 101, 102, 103 and 104 are printed more aesthetically pleasing. For practical purposes, the user of the electrophotographic printing apparatus 100 need only adjust the maximum laydown of the specialty toner 101, 102, 103, and 104 which, in turn, modifies all the other laydowns to meet the target curve 330. This eliminates the user from modifying all the different laydowns individually.

Figure 6:
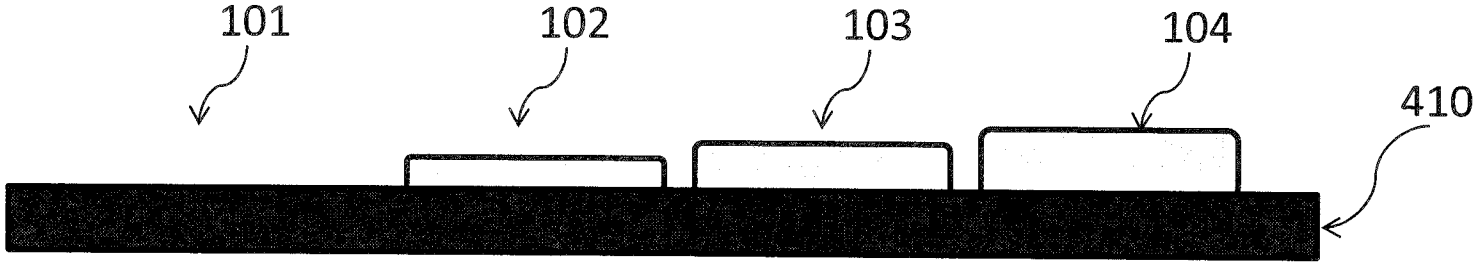
FIG. 6 is a colored substrate having low density specialty toner deposited on the substrate at different laydowns.

Referring to FIG. 6, there is shown an alternative embodiment of the present invention. In this embodiment, the color toner 210 is omitted, and the specialty toner 101, 102, 103 and 104 is deposited directly on and fused to a color substrate 410, preferably a black substrate, also referred to as the calibration document (see FIG. 7). The specialty toner labeled 101 is the 0% laydown case, which in this case will give the maximum signal of the color substrate 410 when the color signal is detected. The color substrate 410 (preferably black) permits the specialty toner 101, 102, 103 and 104 to exhibit the same negatively sloped color signal as in the previous embodiment. The resulting curve would be used in the same manner as in the first embodiment.

Figure 7:
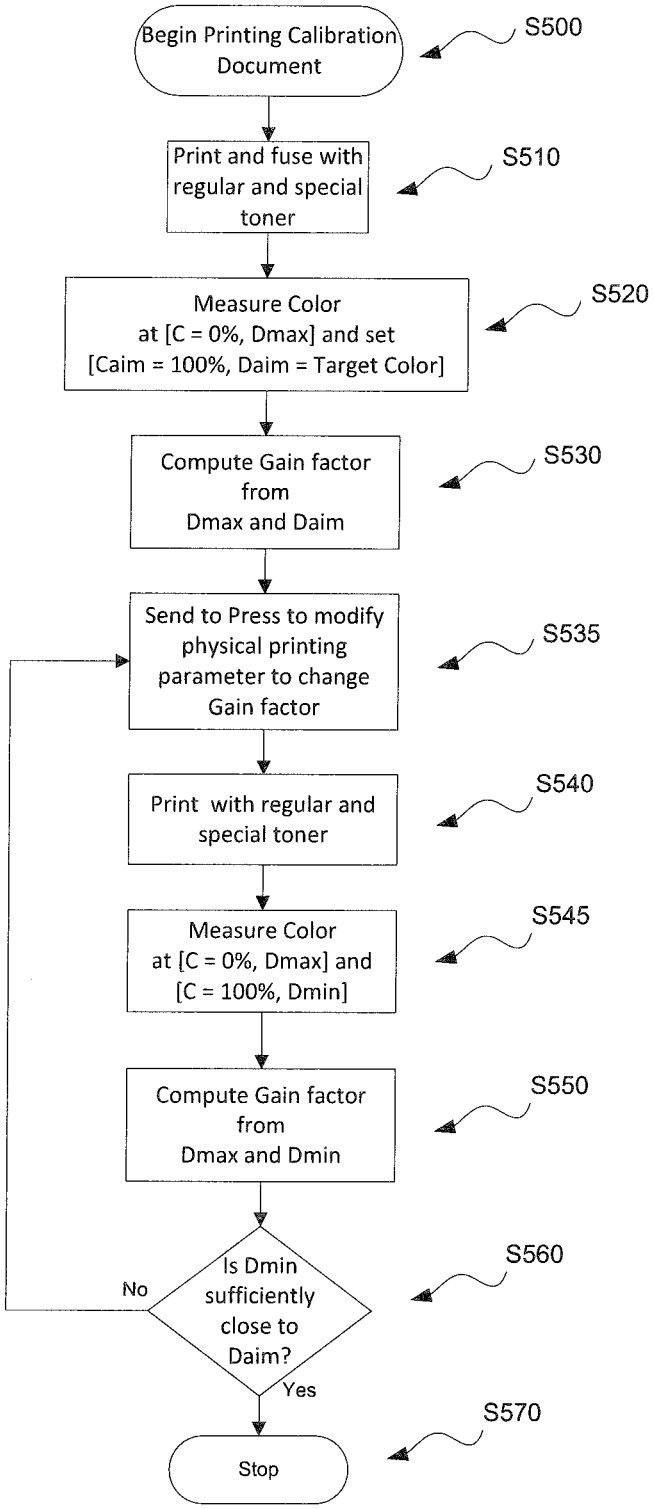
FIG. 7 is a flow chart of the method for calibrating specialty toner.

FIG. 7 describes the process steps useful in a method for calibrating specialty toner. The printer first receives a print request with a predefined calibration document containing various combinations of regular color toner and specialty toner in S500 and S510. The color on the printed target is measured after image fusing in S520. The measured color with 0% laydown (referring to the halftone coverage in the usual case or % exposure in the case of a contone printer) of the specialty toner will have the maximum density reading of the regular toner [Coverage=0% corresponds to Dmax] and the predefined aimed color at 100% laydown of the specialty toner 101, 102, 103 and 104 as described in S520, gives the desired aim density at 100% laydown and the physical gain coefficient. The corresponding toner scale between 0% and 100% specialty toner coverage can be estimated in S530. The estimated coefficients are then sent to the print engine to correct the mismatch as in S535. The print engine will reproduce the same target and measure its color behavior (steps S540-S560). If the error is larger than allowable range S560, the correction will be repeated; otherwise, the calibration will stop S570.

The invention has been described in detail with particular reference to certain preferred embodiments thereof, but it will be understood that variations and modifications can be effected within the spirit and scope of the invention.

PARTS LIST

M1-M5 printing modules
5 receiver material
60 fuser assembly
62 fuser rollers
64 fuser rollers
100 electrophotographic printer apparatus
11 endless transport
12 roller
13 roller
101, 102, 103, 104 specialty toner
110 substrate
111 imaging roller
112 transfer roller
113 transfer backup roller
160 in-line densitometer
161 logic unit
162 light source
163 sensor
210 color toner
230 logic control unit
310 curve
330 target curve
340 typical measured curve
350 typical measured curve
410 color substrate
S500 begin printing step
S510 print target step
S520 measure color step
S530 Compute gain factor step
S535 modify printing parameter step
S540 print with specialized DI step
S545 measure color step
S550 compute gain factor step
S560 allowable range step
S570 stop calibration step

The invention claimed is:

1. A method for calibrating specialty toner, the method comprising:
- providing a substrate;
- depositing an invariant or substantially invariant laydown of a color toner on the substrate;
- depositing a varying laydown of the specialty toner; wherein the color toner is a complementary color of a primary component of the color of the specialty toner;
- fusing the color toner and specialty toner to the substrate;
- measuring a color response signal of the substrate, color toner, and specialty toner;
- calculating a color response curve as function of the varying laydown of the specialty toner;
- comparing the color response curve to a target color response curve; and
- modifying printing parameters of the specialty toner to set the color response curve equal to or substantially equal to the target color response curve; and
- wherein the specialty toner includes either white, clear, pearlescence, metallic or fluorescent toner.

2. The method according to claim 1, wherein the modifying printing parameters includes modifying a maximum laydown of the specialty toner.

3. The method according to claim 1, wherein modifying printing parameters includes modifying a laydown of the specialty toner.

4. The method according claim 1, wherein the color toner includes either black or any combination of cyan, magenta, yellow or black.

5. A method for calibrating specialty toner, the method comprising:
- providing a color substrate;
- depositing varying laydown of the specialty toner; wherein the color substrate is a complementary color of a primary component of the color of the specialty toner;
- measuring a color signal of the substrate, toner, and specialty toner;
- calculating a color response curve as function of the varying laydown of the specialty toner;
- comparing the color response curve to a target color response curve; and
- modifying printing parameters of the specialty toner to set the color response curve equal to or substantially equal to the target color response curve; and
- wherein the specialty toner includes either white, clear, pearlescence, metallic or fluorescent toner.

6. The method according to claim 5, wherein the modifying printing parameters includes modifying a maximum laydown of the specialty toner.

7. The method according to claim 1, wherein modifying printing parameters includes modifying a laydown of the specialty toner.

* * * * *